US009107561B2

(12) United States Patent
Lundberg et al.

(10) Patent No.: US 9,107,561 B2
(45) Date of Patent: Aug. 18, 2015

(54) TABLE TOP DISHWASHER

(75) Inventors: Mats Lundberg, Vaellingby (SE); Luigi Salerno, Ciniselp Balsamo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 23 days.

(21) Appl. No.: 13/989,988

(22) PCT Filed: Sep. 21, 2011

(86) PCT No.: PCT/EP2011/066366

§ 371 (c)(1),
(2), (4) Date: Sep. 9, 2013

(87) PCT Pub. No.: WO2012/072293

PCT Pub. Date: Jun. 7, 2012

(65) Prior Publication Data

US 2014/0159555 A1 Jun. 12, 2014

(30) Foreign Application Priority Data

Nov. 30, 2010 (EP) ..... 10015114

(51) Int. Cl.
*A47L 19/02* (2006.01)
*A47L 15/42* (2006.01)
*A47L 15/00* (2006.01)

(52) U.S. Cl.
CPC ..... *A47L 15/4259* (2013.01); *A47L 15/00* (2013.01); *A47L 15/0089* (2013.01); *A47L 15/4261* (2013.01)

(58) Field of Classification Search
CPC ..... A47L 15/4257; A47L 15/4259; A47L 15/4261; A47L 15/4263; A47L 15/00; A47L 15/0089
USPC ..... 312/228, 296, 319.2, 319.4, 326–329
See application file for complete search history.

(56) References Cited

U.S. PATENT DOCUMENTS 1,853,529 A * 4/1932 Zademach ..... 137/565.36
1,859,302 A * 5/1932 Lederman ..... 220/213

(Continued)

FOREIGN PATENT DOCUMENTS

CN 2903283 Y 5/2007
CN 200984337 Y 12/2007

(Continued)

OTHER PUBLICATIONS

International Searching Authority, International Search Report for International Application No. PCT/EP2011/066366, mailed Apr. 5, 2012, 2 pages, European Patent Office, The Netherlands.

(Continued)

*Primary Examiner* — Hanh V Tran
(74) *Attorney, Agent, or Firm* — Alston & Bird LLP

(57) ABSTRACT

A table top dishwasher may include (a) a tub for accommodating articles to be cleaned; (b) a cover member forming a water-tight hood over the tub, the hood may include a fixed hood portion and a rotatable door which is connected to the fixed hood portion so as to be rotatable between a raised opened position in which it provides access to the tub and a lowered closed position in which the door forms part of the water-tight hood; the dishwasher may further include (c) a lock which when locked maintains the door in the closed position; and (d) a spring mechanism adapted to keep the door partially opened at an intermediate position when the lock is unlocked wherein in the intermediate position the door provides for a gap for venting the hood.

17 Claims, 6 Drawing Sheets

(56) References Cited

U.S. PATENT DOCUMENTS

| | | | | | |
|---|---|---|---|---|---|
| 1,964,578 | A | * | 6/1934 | Hunter | 109/22 |
| 1,980,064 | A | | 11/1934 | Johnston | |
| 2,063,746 | A | | 12/1936 | Meeker | |
| 2,573,794 | A | | 11/1951 | Kueneman | |
| 2,605,776 | A | | 8/1952 | Lyman | |
| 2,722,941 | A | | 11/1955 | Bartlett | |
| 3,466,105 | A | | 9/1969 | Guth | |
| 3,587,939 | A | | 6/1971 | Nystuen et al. | |
| 4,052,954 | A | | 10/1977 | Roy | |
| 4,226,490 | A | | 10/1980 | Jenkins et al. | |
| 4,321,913 | A | * | 3/1982 | Maluta et al. | 600/22 |
| 4,794,847 | A | | 1/1989 | Kreuter et al. | |
| 4,951,693 | A | | 8/1990 | Archambault | |
| 5,172,969 | A | * | 12/1992 | Reuter et al. | 312/328 |
| 5,257,638 | A | * | 11/1993 | Alvemarker | 134/200 |
| 5,845,980 | A | * | 12/1998 | Fricano et al. | 312/327 |
| 6,227,635 | B1 | * | 5/2001 | Teppo et al. | 312/328 |
| 6,478,613 | B1 | | 11/2002 | Zoell et al. | |
| 7,032,985 | B1 | * | 4/2006 | Ichioka et al. | 312/319.2 |
| 7,165,790 | B2 | | 1/2007 | Bella et al. | |
| 7,309,936 | B2 | | 12/2007 | Utsumi et al. | |
| 7,568,601 | B2 | | 8/2009 | Kogami et al. | |
| 7,731,308 | B1 | * | 6/2010 | Riemer | 312/209 |
| 8,016,266 | B2 | | 9/2011 | Bogert | |
| 8,366,214 | B2 | * | 2/2013 | Krammer | 312/327 |
| 2004/0163684 | A1 | | 8/2004 | Hapke | |
| 2005/0022663 | A1 | | 2/2005 | Ford | |
| 2006/0066189 | A1 | | 3/2006 | Bond et al. | |
| 2007/0177995 | A1 | | 8/2007 | Yano | |
| 2008/0035186 | A1 | | 2/2008 | Wegener et al. | |
| 2009/0039745 | A1 | | 2/2009 | Wong | |
| 2010/0130041 | A1 | | 5/2010 | Tsujimoto | |

FOREIGN PATENT DOCUMENTS

| | | | |
|---|---|---|---|
| CN | 201051979 | Y | 4/2008 |
| CN | 201312793 | Y | 9/2009 |
| CN | 101584568 | A | 11/2009 |
| DE | 4438279 | A1 | 5/1996 |
| DE | 102004057019 | A1 | 6/2006 |
| EP | 0709055 | A1 | 5/1996 |
| EP | 1 066 789 | A1 | 1/2001 |
| EP | 1 323 371 | A2 | 7/2003 |
| EP | 2 003 364 | A2 | 12/2008 |
| EP | 2184000 | A1 | 5/2010 |
| JP | 4-306140 | A | 10/1992 |
| JP | 2003-079557 | A | 3/2003 |
| JP | 2004-052080 | A | 2/2004 |
| JP | 2005-034376 | A | 2/2005 |
| KR | 2006-001155 | A | 1/2006 |
| KR | 2006-017175 | A | 2/2006 |
| WO | WO-2010/052021 | A1 | 5/2010 |
| WO | WO-2011/015313 | A1 | 2/2011 |
| WO | WO-2012/016631 | A2 | 2/2012 |
| WO | WO-2012/016632 | A2 | 2/2012 |
| WO | WO-2012/016710 | A2 | 2/2012 |

OTHER PUBLICATIONS

European Search Report for Application No. EP 10 01 5114 dated Jun. 29, 2011.

Office Action for Chinese Application No. 201180057725.9 dated Dec. 2, 2014.

* cited by examiner

TABLE TOP DISHWASHER

CROSS REFERENCE TO RELATED APPLICATIONS

This application is a national stage application, filed under 35 U.S.C. §371, of International Application No. PCT/EP2011/066366, filed Sep. 21, 2011, which claims priority to European Patent Application No. 1001 5114.1, filed Nov. 30, 2010, both of which are hereby incorporated by reference in their entirety.

The present invention relates to a table top dishwasher which comprises a tub for accommodating articles to be cleaned, a cover member forming a water-tight hood over said tub, wherein the hood comprises a fixed hood portion and a rotatable door which is connected to the fixed hood portion so as to be rotatable between a raised opened position in which it provides access to the tub and a lowered closed position in which the door forms part of the water-tight hood.

The term "table top dishwasher" as used herein refers to a dishwasher which in contrast to common floor-mounted appliances is designed as a smaller unit which may be placed for example on a kitchen worktop or which is designed as a portable device. Such dishwashers are particularly suited for smaller households, in which only small amounts of articles are to be cleaned, or for use in mobile vehicles such as motor homes, camper vans, yachts and the like.

It is an object of the present invention to provide for a table top dishwasher of the type indicated above in which the drying efficiency of washing operations carried out in the dishwasher is improved.

In accordance with the present invention the above object is solved in that the dishwasher further comprises lock means which when locked maintains the door in the closed position, and a spring mechanism adapted to keep the door partially opened at an intermediate position when the lock means is unlocked, wherein in said intermediate position the door provides for a gap for venting the hood. Whereas in a table top dishwasher which comprises a hood with a rotatable door which is rotatable between a raised opened position in which it provides access to the tub and a lowered closed position in which the door forms part of the water-tight hood, without the provision of additional measures the rotatable door will be maintained in the closed already by the weight of the rotatable door, in the dishwasher of the present invention, during a washing cycle the door is locked by the lock means, but upon completion of a washing cycle can be released, either manually or preferably program-controlled, wherein due to the action of the spring mechanism the door is partially opened so as to provide for a vent gap. In this manner there can be provided for an exchange of the air within the hood with ambient air, which facilitates and speeds-up the drying process.

Preferred embodiments of the present invention are defined in the dependent claims.

In order to provide for a sufficient exchange of air the intermediate position should be selected such that the door provides for a gap of at least 20 mm and preferably of about 30 to 50 mm.

The spring mechanism can comprise a first spring seat associated to the fixed hood portion, a second spring seat associated to the rotatable door, and a spring which is engaged by the first and the second spring seat when the door approaches its closed position. In such embodiment, while the rotatable door can rotate freely without engagement of the spring in the first part of its travel from the fully opened position towards the closed position. When the approaches its closed position, that is, at or shortly before reaching the intermediate position, the spring engages both the first and the second spring seat, so that the spring is biased when the door is further lowered into the closed position. The angle of rotation of the door by which the intermediate position is offset from the position where the spring engages both the first and the second spring seat will depend on the resilience of the spring(s) and the weight of the door.

While the spring mechanism can comprise any type of spring, such as compression or extensions springs, that are engaged when the door approaches its closed position, in particularly preferred embodiments the spring is a torsion spring which extends substantially coaxially with the axis of rotation of the door and comprises a first and a second leg which engage the first and the second spring seat, respectively, when the door approaches its closed position. In such embodiments the spring can be a torsion spring having a helically coiled central section and a first and a second leg which radial project outwardly from the central section at different angular positions, wherein the stops are arranged such that the door can be rotated freely, i.e. without the stops engaging at the same time the first and second legs, over a major portion of its angular range between the fully opened position and the closed position.

The door can comprise a central region and lateral side regions which are rotatably connected to side portions of the fixed hood portion, wherein the lateral side regions of the door and the side portions of the fixed hood portion form a labyrinth seal to prevent ingress of water into the region of the side portions where the spring mechanism is located. In such embodiments the lateral side regions of the door thus form an enclosure over the region of the side portions where the spring mechanism is located, so as to protect the components of the hinge such as the spring mechanism from contact with water or any substances contained therein, such as detergent, soil particles and the like. The term "labyrinth seal" as used herein should be understood to refer to any kind of shaping of the lateral side regions of the door and the side portions of the fixed hood portion, wherein a sealing effect between the lateral side regions of the door and the side portions of the fixed hood portion is attained due to the geometry of the interface between these parts. While thus a labyrinth seal can be realized by providing for a tortuous interface between the lateral side regions of the door and the side portions of the fixed hood portion so that any liquid would have to repeatedly change is flow direction so as to pass such interface, in the most simple case a labyrinth seal can be implemented by providing for an interface between the lateral side regions of the door and the side portions of the fixed hood portion which interface includes a channel the flow section of which of decreases, such as by providing for a stepped channel.

In further preferred embodiments the dishwasher comprises a rotary damper which dampens rotation of the door, such as a hydraulic damper, and preferably a rotary damper which causes a momentum drag that is proportional to the rotational speed, so as to provide for a smooth movement of the door.

The side portions of the fixed hood portion can comprise a housing member for accommodation of the damper, wherein the housing member preferably is sealingly connected to the side portion of the fixed hood portion. The sealing connection between the housing member and the side portion of the fixed hood portion can be achieved in that the housing member comprises a plurality of wall sections which carve into the side portion of the fixed hood portion. To this end the wall sections of the housing member, or the housing member as such, can be made of a material that is harder than the material of the side portion, wherein the edges of said wall sections preferably are beveled so as to facilitate the harder material wall sections of the housing member to carve into the softer material side portions of the fixed hood portion. For example, whereas the fixed hood portion or at least the side portions thereof could be made of a polypropylene (PP) material, the housing member could be made of a polyoxymethylene (POM) material, which on the one hand is harder than PP and thus when sufficiently pressed against the fixed hood portion will cause the walls of the housing member to carve into the fixed hood portion, and which on the other hand exhibits excellent bearing characteristics when used a bearing surface for movable parts, such as here the rotatable door.

While the rotatable door, which preferably comprises a central region and two lateral side regions, could be pivotably supported at both of its side regions at a pivot point that coincides with the pivot axis, a more stable bearing of the door can be achieved, when each housing member comprises a pair of arcuate guide rails for guiding guide pins that are provided at the lateral side regions of the door.

In order to facilitate assembly of the dishwasher; the fixed hood portion preferably comprises two opposing side portions, wherein the inner faces of the side portions extend in parallel to each other and each comprise at least one alignment groove for accommodation of corresponding alignment protrusions provided at the housing members, wherein the alignment grooves extend continuously to the lower edge of the fixed hood portion so as to accommodate the alignment protrusions during assembly of the dishwasher.

A particular compact design of the dishwasher can be achieved, when the rotatable door, which can be a molded plastic part, has substantially the shape of a cylinder sector and comprises an arcuate central region and two lateral side regions which extend in parallel to each other. Similarly, also the cover member can have generally the shape of a cylinder having horizontal axis and which is flattened in its lower portion where the tub is located. In order to provide in such embodiments for a large as possible access area to the tub, the fixed portion of the central region of the hood preferably spans about half of the circumference of the hood, so that the area that has to be spanned by the rotatable door substantially corresponds to the surface area of the fixed hood portion.

In such latter embodiments the door preferably is designed such that in its opened position it is located below the fixed portion, so that any water that has accumulated during a washing operation at the interior side of the door will be contained within the hood and thus will flow back into the tub.

Preferred embodiments of the present invention will be described below by reference to the drawings, in which.

Figure 1:
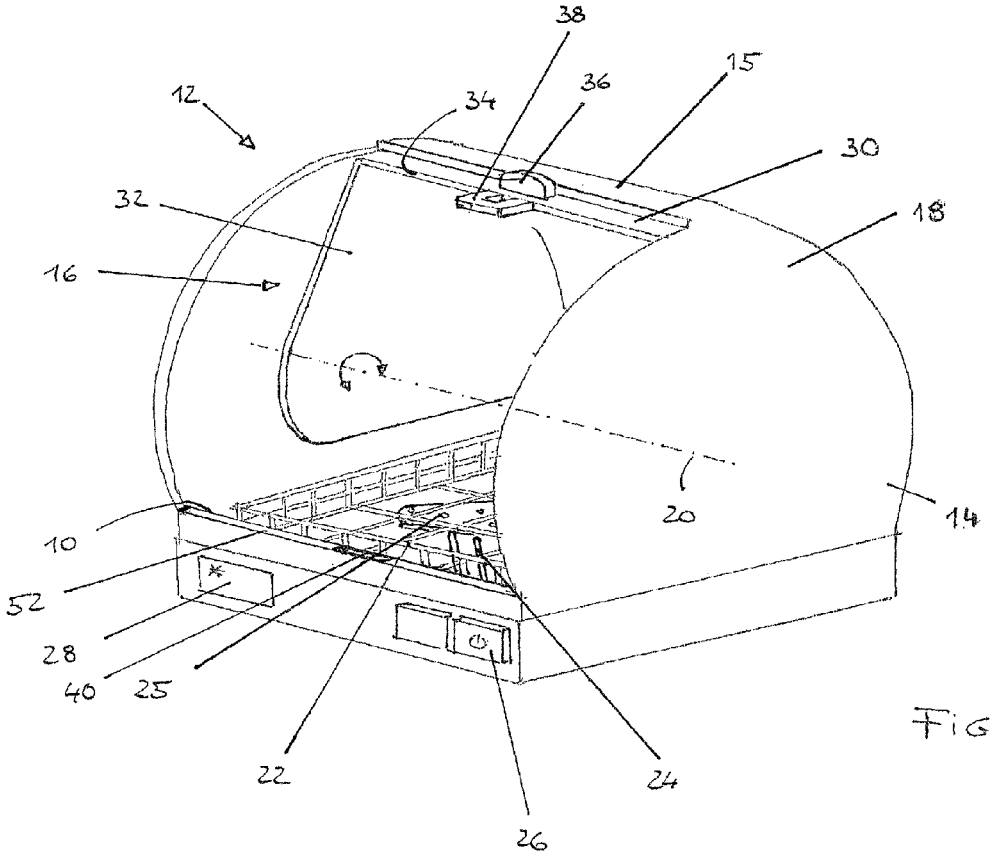
FIG. 1 is a perspective view of a table top dishwasher of the present invention.

FIG. 1 shows a table top dishwasher comprising a tub 10 and a cover member 12, which forms a hood over tub 10. Cover member or hood 12 is a generally cylindrical member comprising a fixed hood portion 14 and a rotatable door 16. Door 16 is rotatably supported at substantially semi-circular side portions 18 of the fixed hood portion so as to be pivotable about a horizontal axis 20. Within tub 10 there is provided a basket 22 which comprises a plurality of holders 24 for accommodating and fixing during a washing cycle a plurality of articles to be cleaned.

Within tub 10 there further are provided means for circulating cleaning liquid throughout the interior of the dishwasher, such as a spray arm 25 that is located below basket 22, and a circulation pump (not shown) and optionally a separate drain pump. In the lower portion of the dishwasher which comprises tub there further can be located any electrical components required for operation of the dishwasher, such as a power supply, a controller and the like, as well as operating switches 26 and a display 28.

As shown in FIG. 1, cover member 12 is a generally cylindrical or semi-cylindrical part, wherein approximately half of the arcuate surface shell is provided by the central region 15 of fixed hood portion 14 and the other half thereof is provided by door 16 which comprises an arcuate central region 30 and two lateral side regions 32. At the lateral side regions 32 door 16 is hinged to the semi-circular side portions 18 of the fixed hood portion 14 so as to be rotatable about axis 20 between the fully opened position shown in FIG. 1 and a closed position which is reached by rotating door 16 in a counter-clockwise direction in FIG. 1 until the lower edge 34 of door 16 contacts a respective sealing surface provided at tub 10.

In the embodiment shown in FIG. 1 door 16 further comprises a handle 50 which facilitates closing of the door and which at the same time provides for a stop which delimits rotation of door 16 at the fully opened position shown in FIG. 1. At the bottom side of lower edge 34 of the door there is provided a catch member 38 which in the closed position of the door is received within a corresponding recess 40 provided at the front wall of tub 10, wherein a latch which is provided within recess 40 and which is operated by the central program unit of the dishwasher maintains the door in the closed position during operation of the dishwasher.

Figure 2:
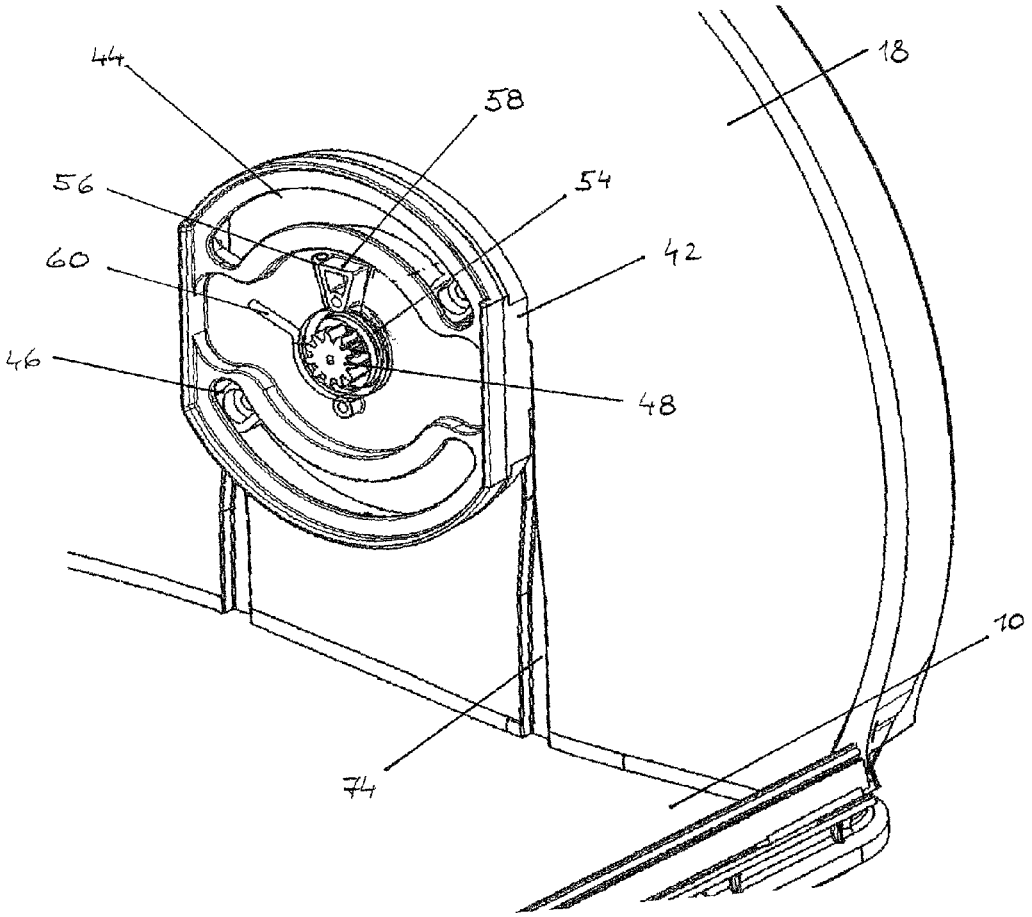
FIG. 2 is a perspective view of the dishwasher of FIG. 1 when the rotatable door has been removed.
Figure 3:
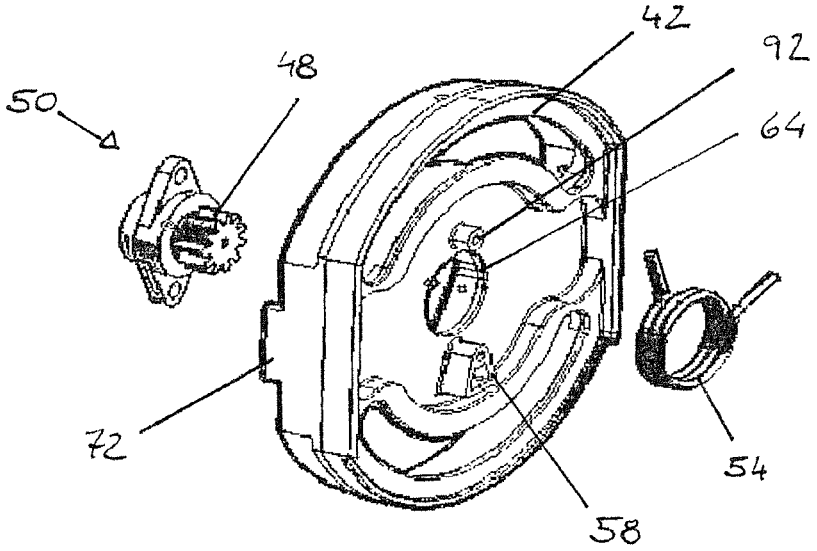
FIG. 3 is an exploded perspective view from below of the hinge mechanism shown in FIG. 2.

FIG. 2 illustrates a dishwasher similar to that shown in FIG. 1 wherein, however, the rotatable door 16 has been removed so that the hinge mechanism of the door becomes visible. The hinge mechanism comprises a housing member 42 which is fixedly connected to the side portion 18 of the fixed hood. Housing member 42 comprises two arcuate guide rails 44 in which there are guided two guide elements 46 (see also FIG. 4) which are fixedly connected to one of the lateral side portions 32 of the rotatable door. In the central region of housing member 42 there is provided a pinion 48 of a rotary damper 50 which is mounted at the rear side of housing member 42 so that only the pinion gear projects from housing member 42 towards the rotatable door. Rotary damper 50 which is also illustrated in the perspective exploded view of FIG. 3 is a commercially available element and for example can be a rotary damper as it is described in EP 2 003 364 A2. While in the embodiment illustrated in FIG. 4 the rotary damper 50 is rotationally fixed with respect to housing member 42 by means of a wall member 66 which is provided at the rear side of housing member 42 and the shape of which corresponds to the outer shape of rotary damper 50, damper 50 alternatively could be attached to housing member 42 by means of fixing elements, such as screws, rivets and the like, that are inserted through apertures 90 of damper 50 and corresponding apertures or tap holes provided 92 (see FIG. 3) provided at housing member 42. While the housing of rotary damper 50 thus is fixed with respect to the housing member 42 which in turn is attached to the side portion 18 of the fixed hood, pinion gear 48 of rotary damper 50 which is in meshing engagement with one or more cams 94 provided at the rotatable door 16 (see FIG. 5) rotates together with the rotatable door 16, so as to provide for a breaking action which smoothens movement of the rotatable door.

In the dishwasher shown in FIG. 1 in which the door 16 is rotatable about horizontal axis 20 the door will be biased towards the fully opened position shown in FIG. 1 as soon as the center of gravity of door 16 is located behind a vertical plane which contains the axis of rotation 20. Similarly, when the door is closed to an extent such that the center of gravity of the door is located in front of the plane containing axis 20, the weight of the door will tend to move the door into the fully closed position. In order to provide for a stop which holds the door at an intermediate position in which the lower edge 34 of the central region 30 of the door is located a few centimeters above the front edge 52 of tub 10, there is provided a spring 54 which in the embodiments shown in FIGS. 2 and 3 is a torsion spring, the coils of which extend about pinion 48 and the ends of which comprise two legs which radially project from the coiled central section. In particular, spring 54 comprises a first leg 56 and a second leg 60, wherein when door 16 is located in a position close to its closed position, first leg 56 rests against a first stop 58 provided at housing member 42, and second leg 60 rests against a second stop 62 provided at the rotatable door.

While FIG. 2 illustrates the components of the hinge mechanism when the door is in the fully closed position wherein the upper guide element 46 of door 16 has reached the front end of its respective guide rail 44, when the door is opened spring 54 which in FIG. 2 is shown in its tensioned state will relax, i.e. the first and second legs 56, 60 will move further apart from each other until the spring force balances the weight of the door. When the door is further opened by manually lifting the door, spring 54 will be maintained in its relaxed state (see FIG. 3), wherein if the second leg 60 is fixed to rotate with the rotatable door 16, the spring will be rotated in its relaxed state so that the first leg 56 comes free of stop 58 and thus spring 54 does not resist the opening movement of the door.

In order to hold the door in the fully closed position against the spring force of springs 54 the door is held by the catch member 38 that is provided at the bottom side of lower edge 34 of the door and which is engaged in the closed position of the door by a latch provided within recess 40. When a washing cycle carried out in the dishwasher is completed, the program control of the dishwasher releases catch member 38 so that the door, by the action of springs 54, is automatically lifted into its intermediate venting position.

Figure 4:
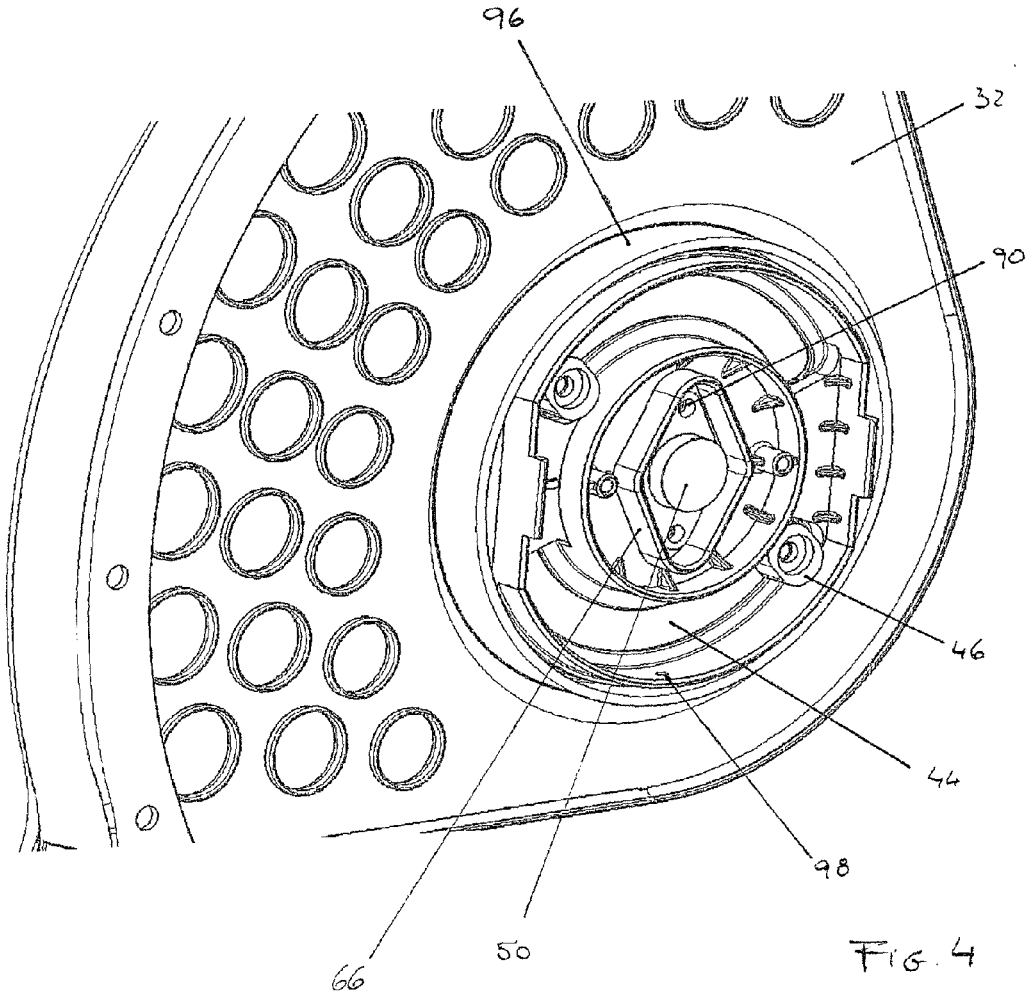
FIG. 4 is a perspective side view of the door of the dishwasher shown in FIG. 1.
Figure 5:
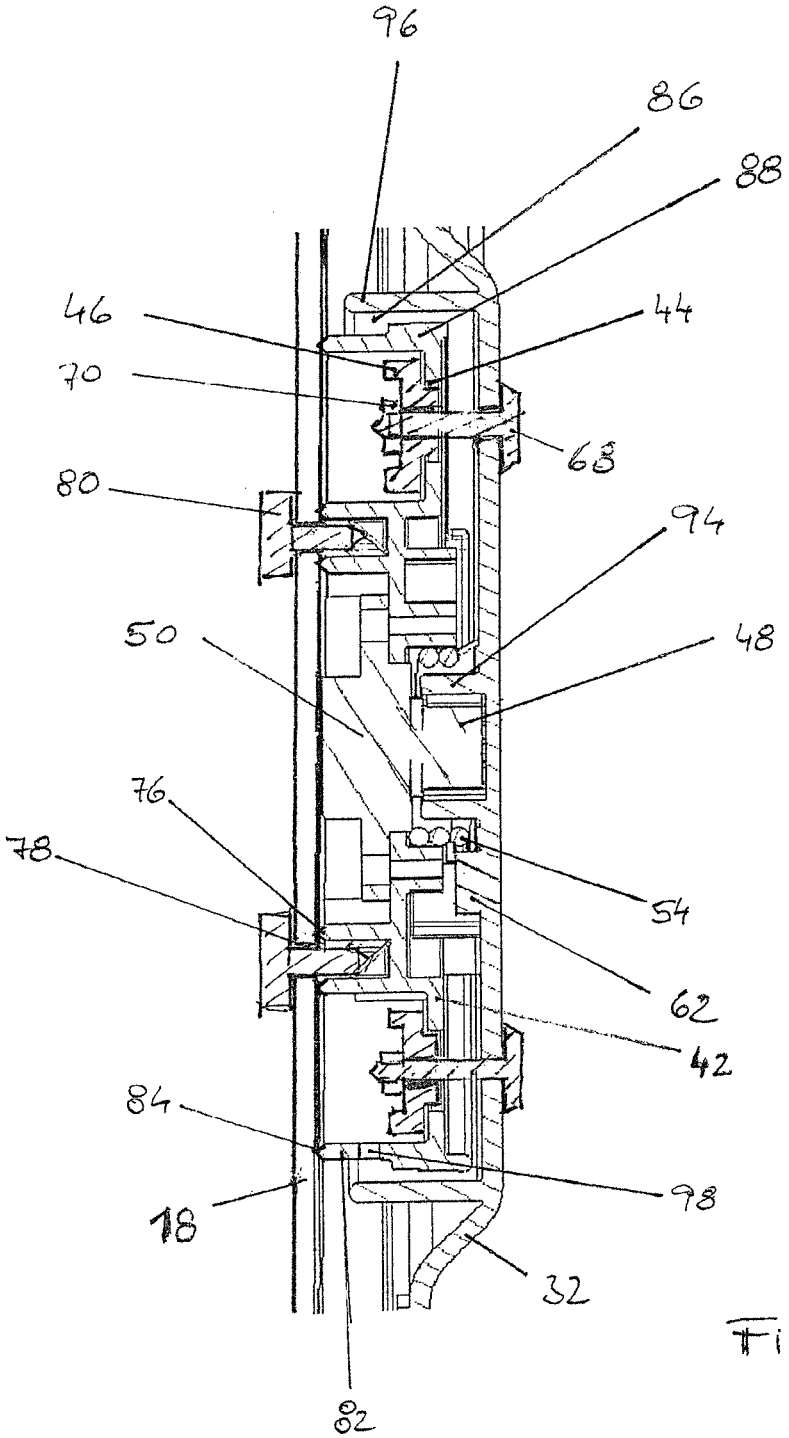
FIG. 5 is a sectional view of the hinge mechanism of the dishwasher shown in FIGS. 1 to 4.
Figure 6:
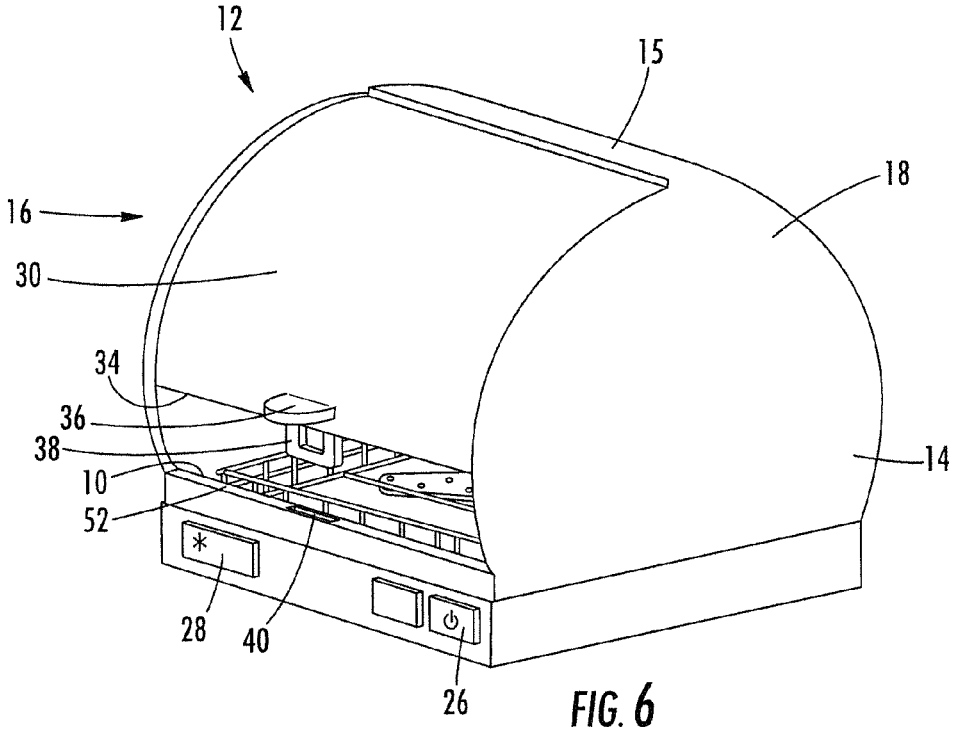
FIG. 6 is a perspective view of a table top dishwasher of the present invention having a door in an intermediate position.
Figure 7:
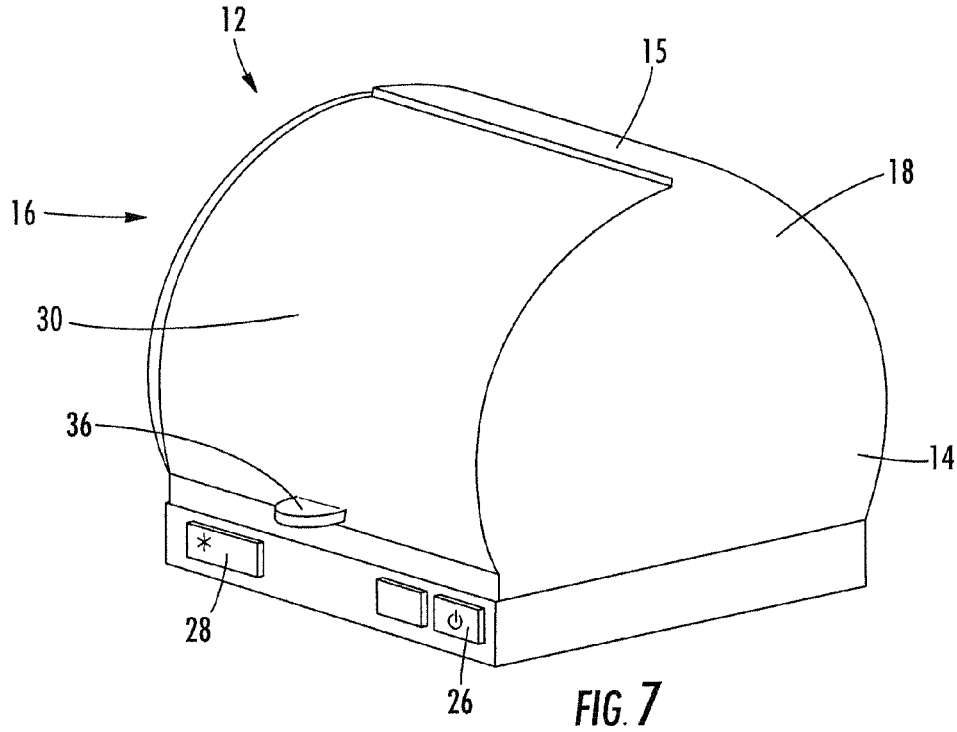
FIG. 7 is a perspective view of a table top dishwasher of the present invention having a door in a closed position.

FIG. 5 shows a sectional view of the hinge mechanism in the assembled state wherein rotary damper 50 with its pinion 48 has been inserted through a central opening 64 provided in housing member 42, so that damper 50 is rotationally fixed with respect to housing member 42 by a wall section 66 provided at the rear side of housing member 42 (see FIG. 4), the shape of which corresponds to the outer shape of rotary damper 50. Upon placement of rotary spring 54 about pinion 48, guide elements 46 are fixedly connected to the side portions 32 of the rotatable door 16 for example by means of screws 68 which are held at guide elements 46 with screw nuts 70.

Upon having installed a hinge mechanism to both lateral side portions 32 of the door 16, the entire assembly is inserted into the fixed hood portion 14. In order to facilitate alignment assembly of door and hinge mechanisms with fixed hood portion, housing members 42 are provided with alignment protrusions 72 which project outwardly, i.e. to the rear side, of housing members 42 and which when inserting the assembly into the fixed hood portion 14 engage respective alignment grooves 74 that are provided at the interior face of side portions 18 of the fixed hood portion. As shown in FIG. 2, the alignment grooves 74 advantageously have a tapered configuration, which facilitates insertion of the alignment protrusions into the alignment grooves. When the alignment protrusions 72 have reached the end of alignment grooves 74, tap holes 76 provided at the rear side of housing member 42 will be aligned to respective opening 78 provided in the side portion 14 of the fixed hood through which screws 80 are inserted so as to attach housing members 42 to side portions 14.

In order to sealingly connect housing member 42 and side portion 14 of the fixed hood member, the housing member 42 is made of a harder material than the fixed hood portion 14 and the respective wall sections 82 which rest against side portion 14 are provided with a beveled edge 84 so that the wall sections 82 carve into the surface of the fixed hood portion.

As is shown in FIGS. 4 and 5, the lateral side portions 32 of the door advantageously are provided with a circular wall 96 which in the assembled state of the dishwasher surrounds the housing member 42, so as to create channel 86. In order to prevent that water which during a washing cycle flows down along the interior side of side portion 18 reaches the central section of housing member 42 where the spring 54 is located, circular wall 96 or, as is shown in FIG. 5, housing member 42 is provided with a tapering 88 so as to create a simple form of labyrinth seal by which the flow section of channel 86 is reduced so as to create a flow barrier for any water that might reach channel 86. While in the absence of any further seals in the hinge mechanism, it cannot be excluded that condensation water collects within the interior of housing member 42, a drain aperture 98 is provided in the bottom wall of housing member 42, so that any water that may collect within housing member 42 can flow out to be returned to the sump of the dishwasher.

REFERENCE SIGNS

10 tub
12 cover member
14 fixed hood portion
15 central region of 14
16 rotatable door
18 side portion
20 horizontal axis
22 basket
24 holder
25 spray arm
26 operating switch
28 display
30 central region of 16
32 side portion of 16
34 lower edge of 16
36 handle
38 catch member
40 recess
42 housing member
44 guide rail
46 guide element
48 pinion
50 rotary damper
52 front edge of 10
54 spring
56 first leg
58 first stop

60 second leg
62 second stop
64 central opening in 42
66 wall
68 screw
70 nut
72 alignment protrusions
74 alignment grooves
76 tap hole
78 opening
80 screw
82 wall sections
84 beveled edge
86 channel
88 tapering
90 aperture
92 aperture
94 cam
96 circular wall
98 drain aperture

The invention claimed is:

1. A table top dishwasher, comprising:

(a) a tub for accommodating articles to be cleaned;

(b) a cover member forming a water-tight hood over said tub, said hood comprising a fixed hood portion having side portions and a rotatable door which is connected to the fixed hood portion so as to be rotatable between a raised fully-opened position in which it provides access to the tub and a lowered closed position in which the door forms part of the water-tight hood;

(c) a lock which when locked is configured to maintain the door in the closed position; and (d) a spring mechanism adapted to keep the door partially opened at an intermediate position when the lock is unlocked wherein in said intermediate position the door provides for a gap for venting the hood, and wherein said intermediate position is defined rotationally between the fully-opened position and the closed position, wherein the spring mechanism comprises a first spring seat associated to the fixed hood portion, a second spring seat associated to the rotatable door, and a spring which is engaged by the first and the second spring seats when the door approaches its closed position, and wherein the spring is a torsion spring which extends substantially coaxially with the axis of rotation of the door and comprises first and second legs which engage the first and the second spring seats, respectively, when the door approaches its closed position.

2. The dishwasher of claim 1, wherein in said intermediate position the door provides for a gap of at least 20 mm.

3. The dishwasher of claim 1, wherein the door comprises a central region and lateral side regions which are rotatably connected to side portions of the fixed hood portion, wherein said lateral side regions of the door and said side portions of the fixed hood portion form a labyrinth seal to prevent ingress of water into the region of said side portions where the spring mechanism is located.

4. The dishwasher of claim 1, further comprising at least one rotary damper which dampens rotation of the door.

5. The dishwasher of claim 4, wherein each of said side portions of the fixed hood portion comprises a housing member for accommodation of a damper.

6. The dishwasher of claim 5, wherein said housing member is sealingly connected to the side portion of the fixed hood portion.

7. The dishwasher of claim 6, wherein said housing member comprises a plurality of wall sections which carve into the side portion of the fixed hood portion.

8. The dishwasher of claim 7, wherein at least said wall sections of the housing member are made of a material that is harder than the material of the side portion.

9. The dishwasher of claim 7, wherein the edges of said wall sections are beveled.

10. The dishwasher of claim 5, wherein the door comprises a central region and two lateral side regions, and wherein each said housing member comprises a pair of arcuate guide rails for guiding guide elements provided at said lateral side regions.

11. The dishwasher claim 5, wherein the inner faces of said side portions extend in parallel to each other and each comprise at least one alignment groove for accommodation of corresponding alignment protrusions provided at said housing members, wherein said alignment grooves extend continuously to the lower edge of the fixed hood portion.

12. The dishwasher claim 1, wherein the rotatable door has substantially the shape of a cylinder sector and comprises an arcuate central region and two lateral side regions which extend in parallel to each other.

13. The dishwasher of claim 1, wherein the door in its opened position is located below the fixed portion.

14. The dishwasher of claim 1, wherein in said intermediate position the door provides for a gap from 30 mm to 50 mm.

15. The dishwasher of claim 1, wherein the lock is configured to release upon completion of a washing cycle, such that the door is configured to open to the intermediate position upon completion of the washing cycle for venting the hood.

16. The dishwasher of claim 1, wherein the door is configured to rotate freely until the spring is engaged by the first and the second spring seats when the door approaches its closed position.

17. The dishwasher of claim 1 further comprising a rotary damper which dampens rotation of the door, wherein one of said side portions of the fixed hood portion comprises a housing member for accommodation of said damper, and wherein at least a portion of the housing member is made of a material that is harder than a material of the side portions.

* * * * *

UNITED STATES PATENT AND TRADEMARK OFFICE

CERTIFICATE OF CORRECTION

PATENT NO. : 9,107,561 B2
APPLICATION NO. : 13/989988
DATED : August 18, 2015
INVENTOR(S) : Lundberg et al.

It is certified that error appears in the above-identified patent and that said Letters Patent is hereby corrected as shown below:

Title page,
Item (75) Inventors: "Ciniselp Balsamo (IT)" should read --Cinisello Balsamo (IT)--.

Signed and Sealed this
Twenty-eighth Day of June, 2016

Michelle K. Lee

Michelle K. Lee
*Director of the United States Patent and Trademark Office*